US011421957B1

(12) United States Patent
Kunau

(10) Patent No.: US 11,421,957 B1
(45) Date of Patent: Aug. 23, 2022

(54) FIREARM RECOIL COMPENSATING SYSTEM

(71) Applicant: Daniel Joseph Kunau, Paragould, AR (US)

(72) Inventor: Daniel Joseph Kunau, Paragould, AR (US)

( * ) Notice: Subject to any disclaimer, the term of this patent is extended or adjusted under 35 U.S.C. 154(b) by 29 days.

(21) Appl. No.: 17/069,338

(22) Filed: Oct. 13, 2020

Related U.S. Application Data

(63) Continuation of application No. 16/133,626, filed on Sep. 17, 2018, now Pat. No. 10,935,338, which is a continuation-in-part of application No. 62/559,529, filed on Sep. 16, 2017, and a continuation-in-part of application No. 29/588,419, filed on Dec. 20, 2016, now Pat. No. Des. 837,924.

(51) Int. Cl.
*F41A 21/38* (2006.01)
*F41A 21/34* (2006.01)

(52) U.S. Cl.
CPC ..... *F41A 21/38* (2013.01); *F41A 21/34* (2013.01)

(58) Field of Classification Search
CPC ..... F41A 21/36; F41A 21/325; F41A 21/30; F41A 21/28; F41A 21/34; F41A 21/38
USPC ..... 89/14.4, 14.1, 14.2, 14.3; 42/107
See application file for complete search history.

(56) References Cited

U.S. PATENT DOCUMENTS 2,667,815 A * 2/1954 Strong ..... F41A 21/36 89/14.3
2,953,972 A * 9/1960 Sorensen ..... F41A 21/325 89/14.3
3,152,510 A * 10/1964 Ashbrook ..... F41A 21/36 89/14.3
3,243,910 A * 4/1966 Weiser ..... F41A 21/42 89/14.3
4,879,942 A * 11/1989 Cave ..... F41A 21/36 89/14.3
5,020,416 A * 6/1991 Tripp ..... F41A 21/38 89/14.3
5,076,137 A * 12/1991 Paredes ..... F41A 21/36 89/14.3
5,092,223 A * 3/1992 Hudson ..... F41A 21/34 89/14.3
5,631,438 A * 5/1997 Martel ..... F41A 21/36 89/14.3
5,698,810 A * 12/1997 Rose ..... F41A 21/32 89/14.3
7,059,235 B2 * 6/2006 Hanslick ..... F41A 21/38 89/14.3

(Continued)

*Primary Examiner* — John Cooper
(74) *Attorney, Agent, or Firm* — Schrantz Law Firm, PLLC; Stephen D. Schrantz

(57) ABSTRACT

The suppression device and system attaches to the muzzle end of the barrel. A vent in the suppression device releases the gases from the barrel in a direction to compensate for drift and recoil. The suppression device adjusts to change the direction and distance from the user at which the device vents the gas. The user adjusts the positioning of the vent on the barrel to control the distances from which the vent is located from the user. The user also adjusts the direction of the vent. The vent directs the gases in a direction chosen by the user from a location designated by the user. Such adjustability enables the user to adapt the suppressor device to the user's specific needs.

16 Claims, 8 Drawing Sheets

(56) References Cited

U.S. PATENT DOCUMENTS

| | | | | |
|---|---|---|---|---|
| D837,924 | S * | 1/2019 | Kunau | D22/108 |
| 10,935,338 | B1 * | 3/2021 | Kunau | F41A 21/34 |

* cited by examiner

FIREARM RECOIL COMPENSATING SYSTEM

CROSS-REFERENCE TO RELATED APPLICATIONS

This application claims priority to and is a continuation of U.S. patent application Ser. No. 16/133,626 filed on Sep. 17, 2018 entitled "FIREARM RECOIL COMPENSATING SYSTEM" that is a continuation-in-part of U.S. patent application Ser. No. 29/588,419 filed on Dec. 20, 2016 entitled FIREARM SUPPRESSOR that issued as U.S. Pat. No. D837,924 on Jan. 8, 2019.

U.S. patent application Ser. No. 16/133,626 filed on Sep. 17, 2018 entitled "FIREARM RECOIL COMPENSATING SYSTEM" is a continuation-in-part of U.S. Patent Application No. 62/559,529 filed on Sep. 16, 2017 entitled "Improved Multipurpose Firearm Muzzle Device." These applications are hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to firearms and reducing muzzle rise and muzzle drift occurring during the firing of the firearm. Users seek to avoid muzzle rise and muzzle drift. Users also seek to reduce recoil during the firing of the firearm.

Firearms discharge the shot, bullet, or projectile via explosive, typically by the combustion of gunpowder. Such combustion produces gases that are placed under great pressure due to the barrel. The buildup and explosive release of the gases create recoil. This recoil action delivers a jolt to the shoulder of the shooter. The recoil and muzzle climb also disturb the shooter's aim for subsequent shots.

Maintaining the firearm in a stable position improves the accuracy of the shots. Avoiding muzzle rise and drift improves the accuracy of follow up shots. The firearm muzzle may move after each shot. These movements result due to the line of recoil in a firearm being offset from location at which the firearm is supported. The firearm moves in the direction of the least amount of support. These movements can also be caused due to the shooter's trigger squeeze due to the trigger being pulled to the side.

The present invention couples to the muzzle end of a firearm's barrel. The present invention directs propellant gases to counteract movement of the barrel that occurs during firing. The present invention also directs the gases radially outward from the bore to reduce muzzle rise and drift either left or right. One embodiment of the present invention directs the propellant gases rearward to reduce the recoil upon firing.

It would be desirable to reduce the recoil, rise, and drift of the firearm. It would be further desirable to provide an attachment for reducing the recoil from discharged firearms which can be readily installed on the end of the barrel.

II. Description of the Known Art

Patents and patent applications disclosing relevant information are disclosed below. These patents and patent applications are hereby expressly incorporated by reference in their entirety.

U.S. Pat. No. 9,303,939 issued to Brinkmeyer on Apr. 5, 2016 ("the '939 patent") teaches muzzle brakes, kits, and weapons systems (e.g., rifles) that allow for incremental adjustment of the ports of a muzzle brake so that the muzzle brake can be tuned for the user and firearm system. In certain aspects, the disclosure taught by the '939 patent provides muzzle brake plugs having an interior surface defining a plug bore that extends at least partially through the thickness of the muzzle brake plug and muzzle brakes having a plurality of side ports extending laterally away from a central bore and arranged to replaceably receive muzzle brake plugs. A bottom wall closing the plug bore of a muzzle brake plug taught by the '939 patent can be selectively drilled or punch-out to create or enlarge an opening with the plug bore, thus allowing a shooter to tune the muzzle brake to the firearm system.

U.S. Pat. No. 5,844,162 issued to Renner on Dec. 1, 1998 ("the '162 patent") teaches a muzzle-loading rifle having vents cut into the barrel near its muzzle. The rifling taught by the '162 patent is timed with respect to the placement of the vents such that all vents are located within the rifling grooves. Depending on the number and size of the vents, the rifling grooves taught by the '162 patent may be relatively wide and the rifling twist relatively slow to ensure that all vents remain in the rifling grooves.

U.S. Pat. No. 5,425,298 issued to Coburn on Jun. 20, 1995 ("the '298 patent") teaches a rifle that has an adjustable muzzle brake attached to a muzzle end of the rifle, the muzzle brake including an inner sleeve surrounded by an outer sleeve. The two sleeves taught by the '298 patent are rotatable with respect to each other and have a pattern of holes formed in each. A pair of detent mechanisms formed in the inner and outer sleeves taught by the '298 patent allow the outer sleeve to rotate to a first position with respect to the inner sleeve where the holes of both sleeves are aligned with each other. In this position, the '298 patent teaches that the gases of combustion can escape through the aligned holes in both sleeves in a substantially transverse direction to the axis of the gun barrel. The '298 patent teaches that this provides for a significant reduction in the amount of recoil force on the shooter of the rifle. The detent mechanisms taught by the '298 patent also allow the outer sleeve to be rotatable to a second position where the holes of the inner and outer sleeves are totally out of alignment with each other. In this position the '298 patent teaches that the gases are not allowed to escape transversely to the axis of the gun barrel, but instead follow the bullet out the muzzle end of the muzzle brake.

U.S. Pat. No. 5,320,022 issued to Kimbro on Jun. 14, 1994 ("the '022 patent") teaches a method and apparatus for reducing the recoil and muzzle climb from the discharge of a firearm. A hollow cylinder member having a front end with a restricted opening forming a gas chamber taught by the '022 patent is attached to the muzzle end of a firearm and serves to rearwardly divert the highly pressurized gas produced from the combustion of gunpowder. The cylinder member taught by the '022 patent is provided with rearwardly angled holes along both its top and bottom surface which act as jets to create a forward propulsive force from the expelled gas. The '022 patent teaches that this forward force counteracts and reduces the backward force of the firearm's recoil. The '022 patent teaches that by providing a greater ratio of top holes to bottom holes, thereby effecting a downward force greater than the upward force, muzzle climb can also be reduced.

SUMMARY OF THE INVENTION

The present invention is useful for accurate and precise shooting. The present invention provides a suppression device that reduces recoil, drift, and rise. In some embodiments, the suppression device also reduces the flash associated with firing the firearm. The suppression device attaches to the end of the barrel of the firearm. The system of the present invention provides additional restrictor bodies that allow for incremental adjustment of the suppression device. The restrictor bodies adjust the positioning of the device on the barrel and the direction of the vent while securely attaching the suppression device to the barrel.

The present invention provides a firearm muzzle device that uses the radial gap effect of a slot perpendicular to the barrel-bore to reduce recoil, muzzle rise, side drift, flash signature, and muzzle blast. The effect is adjustable in several ways, including distance device is threaded onto muzzle and distance bushing is threaded into muzzle device. Effectiveness can also be altered by changing slot angle from perpendicular; possibilities include angling top of slot slightly away from muzzle outlet. Various muzzle devices can be attached to threaded bushing to achieve desired results. Another embodiment of the present invention provides a firearm muzzle device that uses tapered jets to minimize muzzle rise, side drift, recoil, or a combination.

Each user may support the firearm in a different manner due to the method in which in which the user fires the firearm. The user may pull the trigger to cause drift of the firearm to the side, either left or right. The user may also support the firearm in a manner that causes the muzzle of the firearm to rise after firing. Because of these differences in supporting and firing the firearm, the firearm will drift, rise, and recoil differently for each user.

The suppression device adjusts to change the direction and distance from the user at which the device vents the gas. The adjustability of the suppression device enables the user to adjust the suppression system specifically for the user. Such adjustment enables the suppression device to react according to the manner in which the user supports and fires the firearm.

The suppression device provides a bore through which the projectile travels. The bore of the suppression device aligns with the bore of the barrel. Such alignment enables the projectile to travel through the bores of the barrel and the suppression device. The user adjusts the positioning of the vent on the barrel to control the distances from which the vent is located from the user. The user also adjusts the direction of the vent. The vent releases the gas to counteract the rise and drift of the muzzle.

The direction of gas flow moving through the vent and the amount of pressure generated by the shot dictates how much compensation force is generated by the suppression device. In one embodiment, the vent is slanted rearwards to vent the gas rearwards toward the user. Such rearward vent enables the vent to compensate for recoil.

A suppressor body of the suppressor device provides a central bore and a vent aperture communicating with the central bore. The central bore extends through the length of the suppressor body. The vent extends laterally from the bore to expel the gases from the barrel to the side.

The present invention also discloses a firearm kit for adjustment of the suppression system. Two restrictor bodies secure to the barrel for fine tuning placement of the suppressor device and the vent.

Further forms, objects, features, aspects, benefits, advantages, and embodiments of the present invention will become apparent from a detailed description and drawings provided herewith.

Other objects, features, and advantages of the invention will be apparent from the following detailed description taken in connection with the accompanying drawings.

It is an object of the present invention to provide an expansion chamber at the end of the barrel.

It is another object of the present invention to provide a radial gap effect to vent the gas radially from the bore.

It is another object of the present invention to reduce drift of the firearm to either side.

It is another object of the present invention to reduce muzzle rise of a firearm.

It is another object of the present invention to reduce recoil of the firearm.

It is another object of the present invention to vent high-pressure gas through a radial gap to allow controlled expansion and directed flow to reduce recoil, muzzle rise, and flash signature.

It is another object of the present invention to direct high velocity gas perpendicular to barrel to reduce recoil by gas jet thrust pushing to the sides, rather than front of barrel.

It is another object of the present invention to direct high velocity gas perpendicular to barrel by directing jet thrust upward resulting in downward force, preventing barrel rise.

It is another object of the present invention to improve the effectiveness of reducing recoil while reducing muzzle-rise by altering the slot angle, as in angling away from muzzle outlet.

It is another object of the present invention to provide an adjustable threaded bushing to increase or decrease muzzle-rise, recoil reduction, and side drift prevention by turning bushing farther or less into muzzle device.

It is another object of the present invention to position the outlet of the muzzle device.

It is another object of the present invention to provide a muzzle device that serves as a mounting base for sound suppressor.

It is another object of the present invention to direct high velocity gas perpendicular to the barrel to reduce barrel rise by upward jet thrust causing downward force on barrel.

It is another object of the present invention to direct high velocity gas at an angle away from muzzle to reduce recoil/backward thrust by causing forward force on barrel.

In addition to the features and advantages of the suppression device and system according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
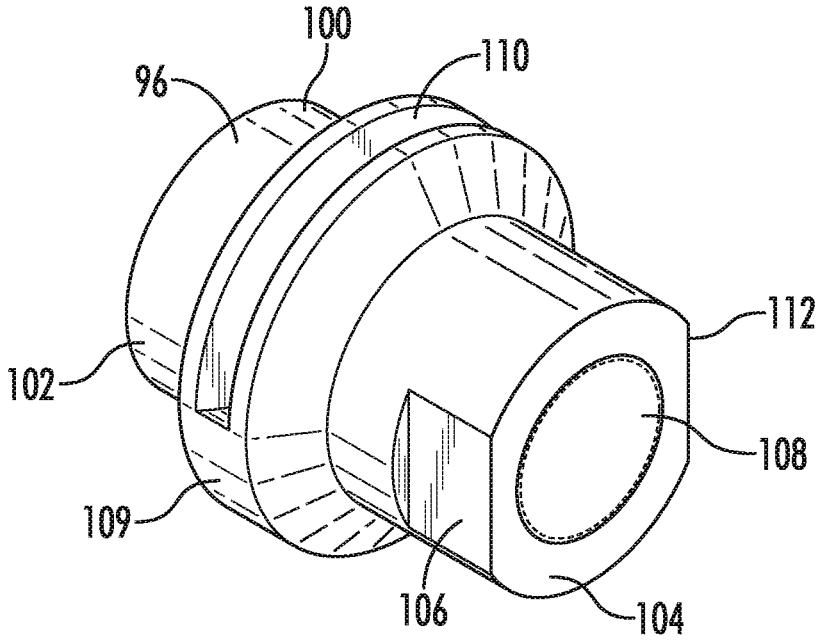
FIG. 1 is a perspective view showing one embodiment of the present invention.

Referring to FIGS. 1-7, the suppression device 100 of the present invention is generally illustrated by reference numeral 100. The suppression device 100 reduces recoil, drift, and rise. The suppression device 100 reduces the flash associated with firing the firearm. The suppression device 100 attaches to the end of the barrel of the firearm.

The suppression device 100 provides a bore 108 through a suppression body 96 through which the projectile travels. The bore 108 of the suppression device 100 aligns with the bore of the barrel. Such alignment enables the projectile to travel through the bores of the barrel and the suppression device 100.

The suppression device 100 also provides a vent aperture 110. The vent aperture 110 extends radially outward from the bore 108. Suppressor tail 102 attaches to the barrel. Suppressor tail 102 attaches closest to the user. Suppressor head 104 is located further away from the user.

The direction of gas flow moving through the vent and the amount of pressure generated by the shot dictates how much compensation force is generated by the suppression device. In one embodiment, the vent is slanted rearwards to vent the gas rearwards toward the user. Such rearward vent enables the vent to compensate for recoil.

Grips 106, 112 provide a flattened surface. The user can then adjust the positioning of the suppressor device 100 on the barrel by turning the suppressor device 100. In one embodiment, the suppressor device 100 provides threads at one or both ends at suppressor tail 102 and suppressor head 104. Suppressor tail 102 provides threads for securing the suppressor device 100 onto the barrel. Suppressor head 104 provides threads for securing a bushing to the suppressor head 104.

The bore 108 extends through the suppressor device 100. The bore extends from suppressor tail 102 through suppressor head 104. The suppressor shoulder 109 is located between the suppressor tail 102 and suppressor head 104. The suppressor shoulder 109 provides an expansion chamber for venting gases and allowing the gases to expand as the gases travel through and exit the barrel.

Figure 2:
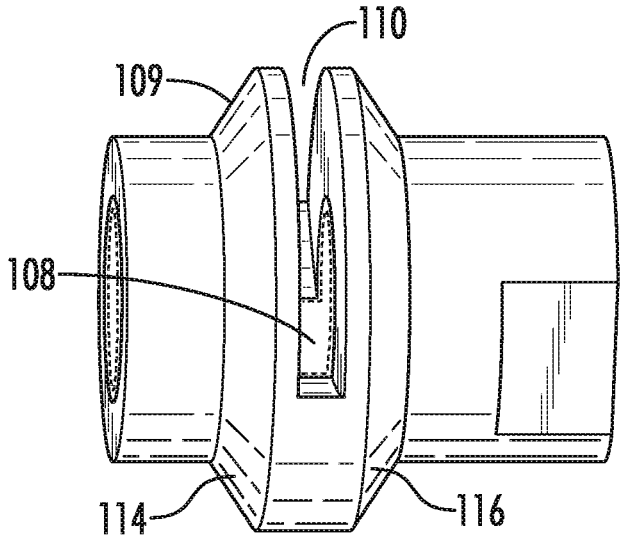
FIG. 2 is a perspective view thereof.

The vent aperture 110 increases the area for expansion of the gases as shown in FIG. 2. The cross-section of the bore 108 at shoulder 109 is greater than the cross-section of the bore at suppressor tail 102 and suppressor head 104. This increased cross section at vent aperture 110 enables gas expansion at vent aperture 110.

Figure 3:
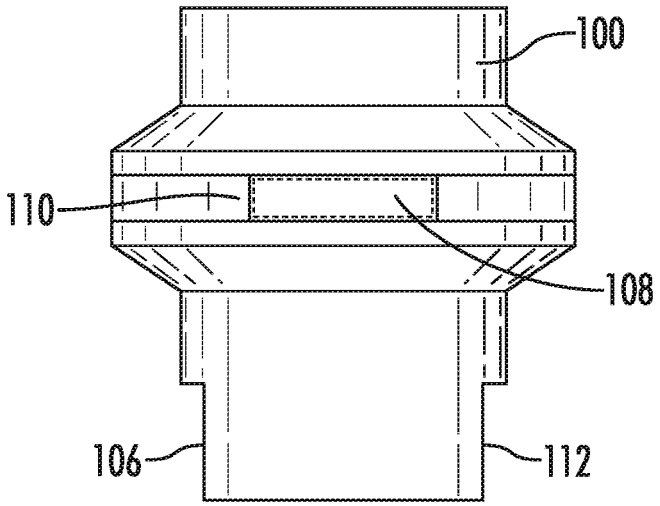
FIG. 3 is a top view thereof.
Figure 4:
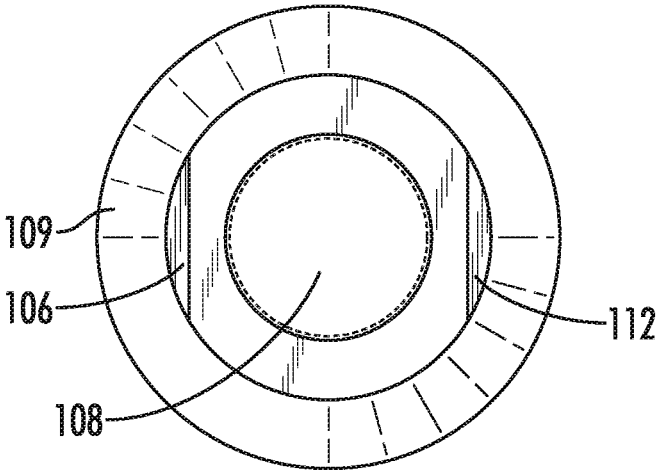
FIG. 4 is a front view thereof.
Figure 5:
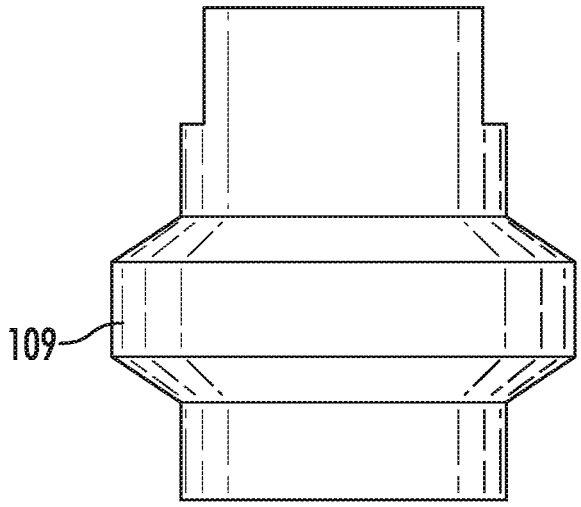
FIG. 5 is a bottom view thereof.

FIG. 3 shows the grips 106, 112. The grips 106, 112 improve the user's ability to twist the suppression device 100. Twisting the suppression device 100 enables the user to position the vent aperture 110. The user positions the distance of the vent aperture 110 from the barrel end/muzzle. The user can adjust the orientation of the vent aperture to direct the gas in a particular direction. The user can also adjust the positioning of the vent to adjust the leverage arm of the gases at vent aperture 110. The vent aperture 110 communicates with the bore 108. Some of the gases, preferably most of the gases of one embodiment, escape the barrel through the vent aperture 110.

Figure 6:
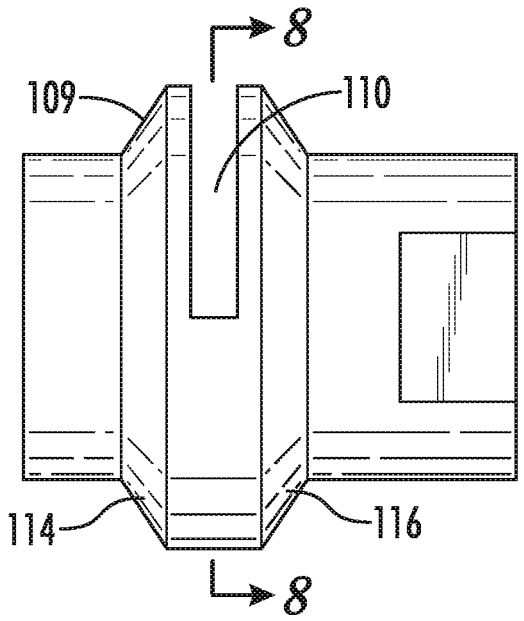
FIG. 6 is a left side view thereof with the right side view being a mirror image of the left side view.

FIGS. 2 and 6 show lower shoulder 114 and upper shoulder 116. Lower shoulder 114 is located anterior of the upper shoulder 116. The projectile moves from lower shoulder 114 to upper shoulder 116. The cross section of the shoulder 109 increases along lower shoulder 114 from suppressor tail to vent aperture 110. The cross section of the shoulder 109 decreases along upper shoulder 116 from aperture vent 110 to suppressor head.

Figure 7:
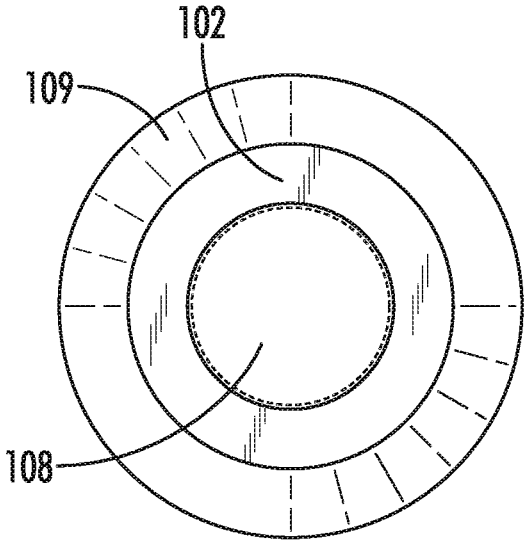
FIG. 7 is a rear view thereof.

FIG. 7 shows the suppressor tail 102 and shoulder 109. The vent extends outward to shoulder 109 as shown in FIG. 6.

Figure 8:
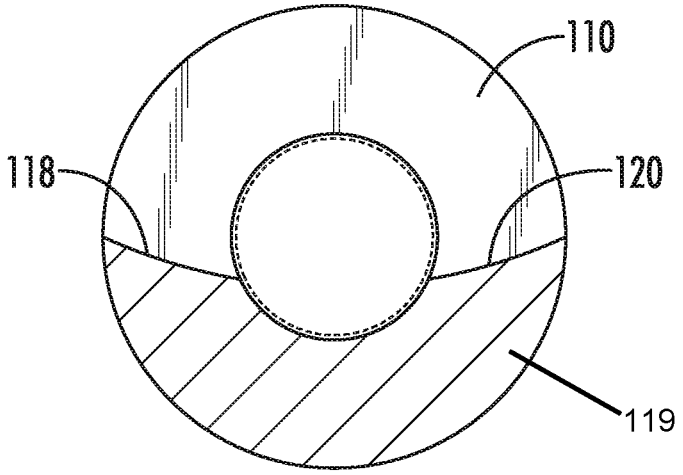
FIG. 8 is a sectional view thereof.

FIG. 8 shows one embodiment of the present invention in which the vent aperture 110 provides a curved surface at lips 118, 120 from the bore. The curved surface of lips 118, 120 directs the gas towards the vent aperture. The curved surfaces of the lips 118, 120 may increase the speed at which the gas flows through the vent aperture 110. Such increased speed increases the thrust that occurs at the vent aperture.

The lips 118, 120 of one embodiment have the same curvature. The lips 118, 120 shown from the transverse plane perpendicular to the bore curve towards the vent aperture 110. Exhaust arc 119 forms a portion of the bore. Lips 118, 120 form the ends of the exhaust arc 119. The ends of the exhaust arc 119 curve towards the vent aperture to direct the gases to the vent aperture 110. In one embodiment, the vent aperture 110 is formed by a radial cut into the housing. Lips 118, 120 are arcs of the same circular cut into the housing.

Figure 9:
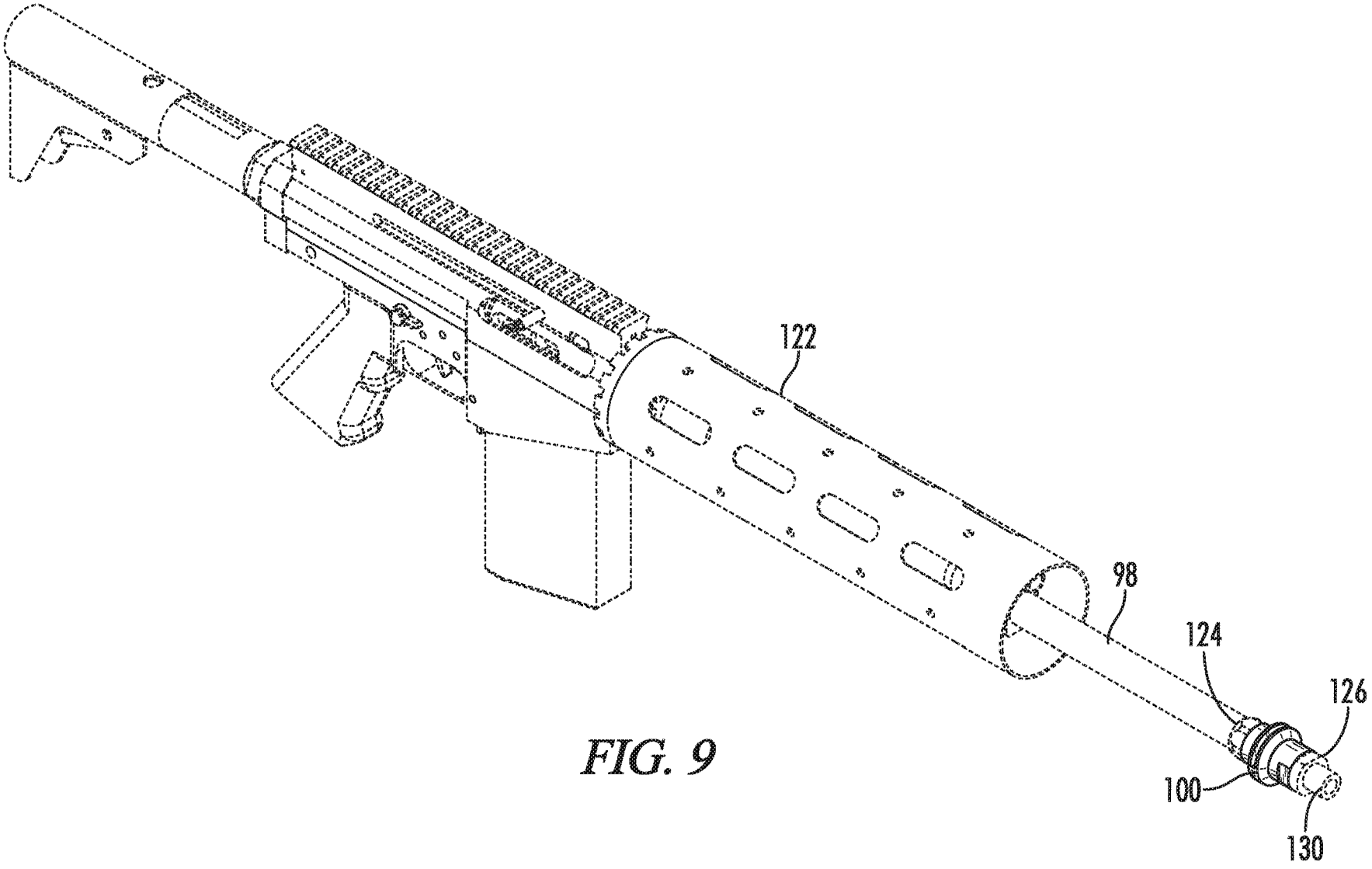
FIG. 9 is an environmental view thereof.

FIG. 9 shows the suppressor device 100 installed on the barrel 98 of firearm 122. Restrictor bodies 124, 126 enable the adjustment of the suppressor device 100. Restrictor bodies 124, 126, such as nuts, enable the fine tuning of the suppressor device 100. Restrictor bodies 124, 126 allow positioning of the vent aperture to direct the exhaust gases. The restrictor bodies 124, 126 also allow changing the distance from the barrel at which the vent is located, thus changing the leverage arm.

FIGS. 9-12 show the suppressor device 100 secured with the suppressor 128. Restrictor body 126 enables fine tuning of the position of vent 110 before attaching the suppressor 128. Adjustable threaded bushing 130 enables the attachment of the restrictor body 126 and suppressor 128 to the suppression device 100. The bushing 130 provides threads for securing to the suppressor device 100 and the suppressor 128. The threads enable adjustment of the bushing 130 to adjust the distance of the muzzle to the suppression device 100. Restrictor bodies 124, 126, 127 secure the suppression device 100, the adjustable bushing 130, and the suppressor 128.

As shown in FIG. 9, the suppression device 100 positions the expansion chamber at the end of the barrel. Vent aperture 110 enables the user to vent the gases upwards or to the side to reduce muzzle rise and/or muzzle drift, movement to the side. In one embodiment, the vent aperture is slanted backwards towards suppressor tail to direct the gas rearwards toward the user. Such slanting backwards directs the gas rearwards to counter recoil.

Restrictor bodies enable the user adjusts the length of the reversing/expansion chamber. The user may twist the suppression device on or off the barrel. The user may also adjust the distance of the vent aperture from the user by twisting the suppression device. The user varies the size of the reversing/expansion chamber by adjusting the placement of the bushing 130 to position the suppression device and the suppressor.

In one embodiment, the vent aperture extends radially outward from the bore. In one embodiment, the vent aperture is perpendicular to the bore. In another embodiment, the vent aperture is slanted rearwards towards the user to reduce recoil.

The curved surface of the suppression device directs the gas through the vent. The lips function similar to a rocket nozzle that increases the speed at which the gas flows through the vent aperture. Such increased speed of the gas through the vent aperture increases the thrust caused at the vent. The vent releases the gas to counteract the rise and drift of the muzzle.

The user may adjust the positioning and direction of the suppression device 100 in relation to the user. Such adjustment enables the user to orient the vent and position the vent according to the user's preferences.

Figure 11:
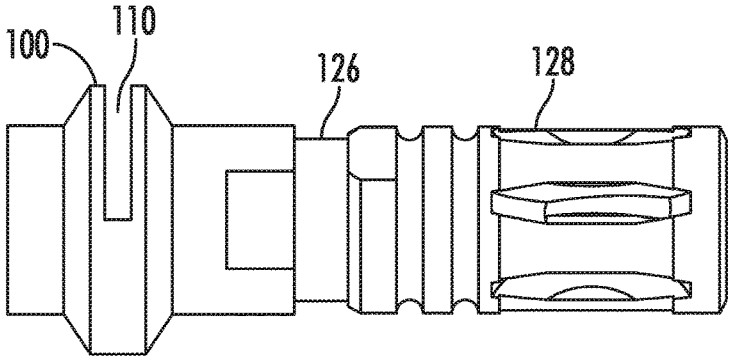
FIG. 11 is an environmental view thereof.

FIG. 11 shows the vent 110 directed upwards. Directing the vent 110 upwards directs the high pressure gas upwards to reduce muzzle rise when using the firearm.

Figure 12:
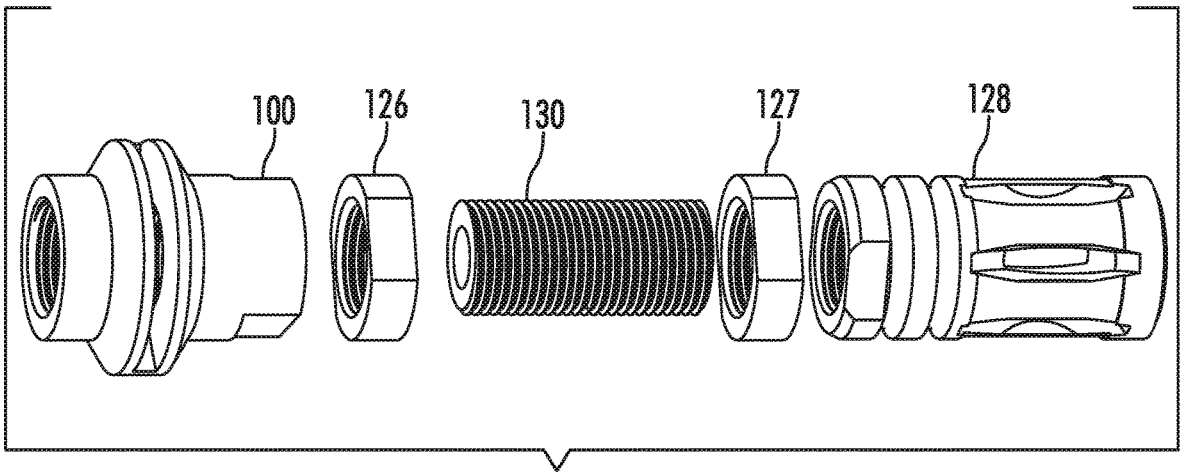
FIG. 12 is an environmental view thereof.

FIG. 12 shows an exploded view of the suppression system 100. Bushing 130 provides a bore 132 as shown in FIG. 12. Restrictor bodies 126, 127 secure the positioning of the suppression device 100 and the suppressor 128. Restrictor body 126 secures the position of the suppression device 100. Restrictor body 127 secures the position of the suppressor 128. The use of two restrictor bodies 126, 127 enables greater customization of the present invention. The user can adjust the positioning of the suppressor device 100 and the suppressor 128. The distance between the suppressor device 100 and the suppressor 128 varies according to placement of the restrictor bodies 126, 127, such as nuts. Therefore, the user can adjust the distance between the suppressor device 100 and the user. The user can also adjust the distance between the suppressor 128 and the user.

Figure 13:
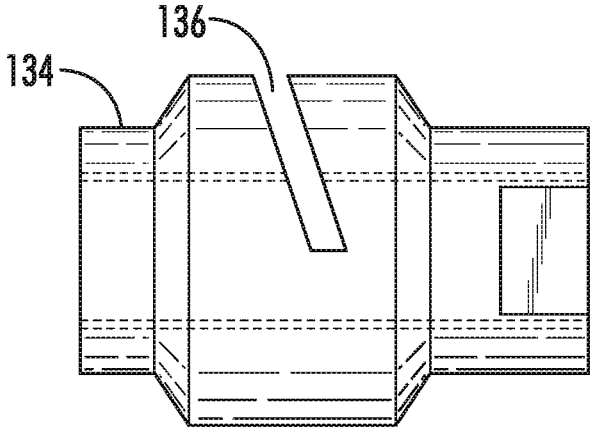
FIG. 13 is a left side view showing one embodiment of the present invention, the right side view being a mirror image of the left side view.
Figure 14:
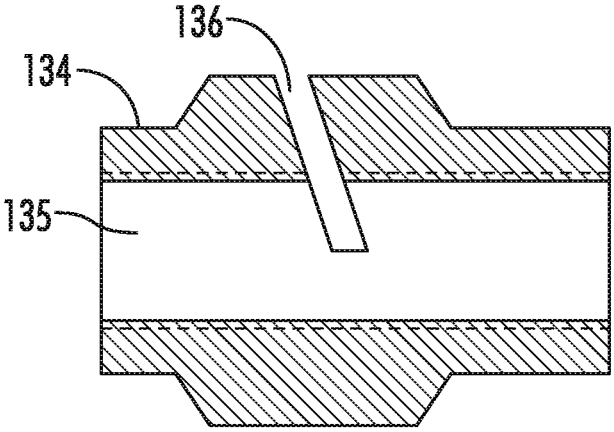
FIG. 14 is a sectional view thereof.

FIGS. 13 and 14 show another embodiment of the present invention. Suppressor device 134 provides an angled vent 136 that is directed backwards towards the user. Such a vent 136 may be angled at 60 to 75 degrees from the axis that extends along the bore 135 of the firearm from the user.

Figure 15:
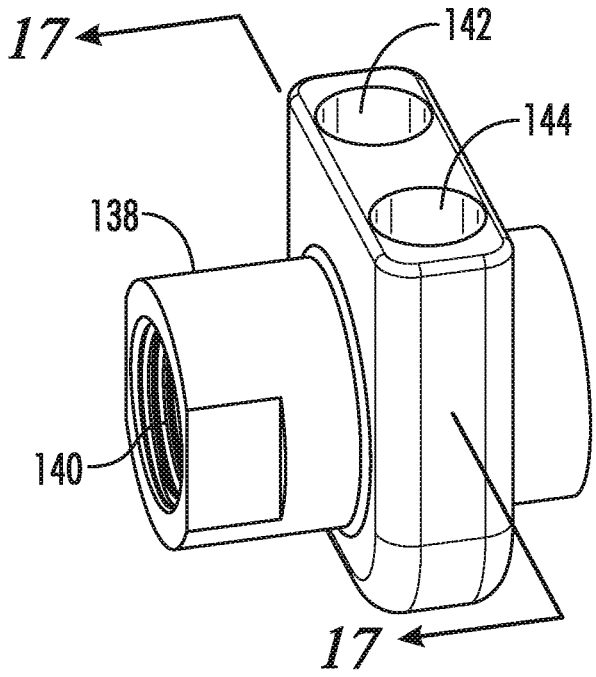
FIG. 15 is a perspective view showing one embodiment of the present invention.
Figure 16:
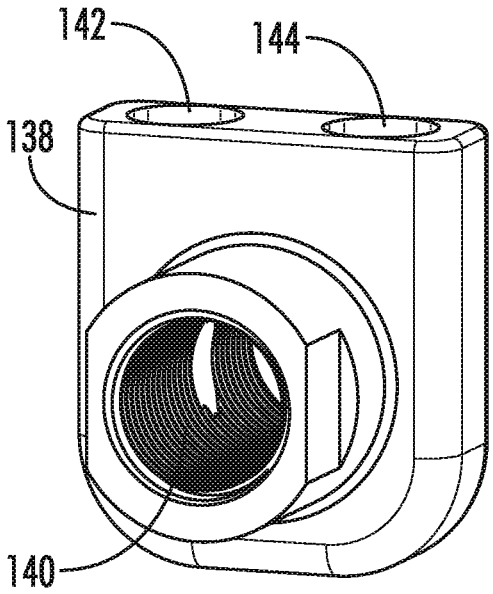
FIG. 16 is a perspective view thereof.
Figure 17:
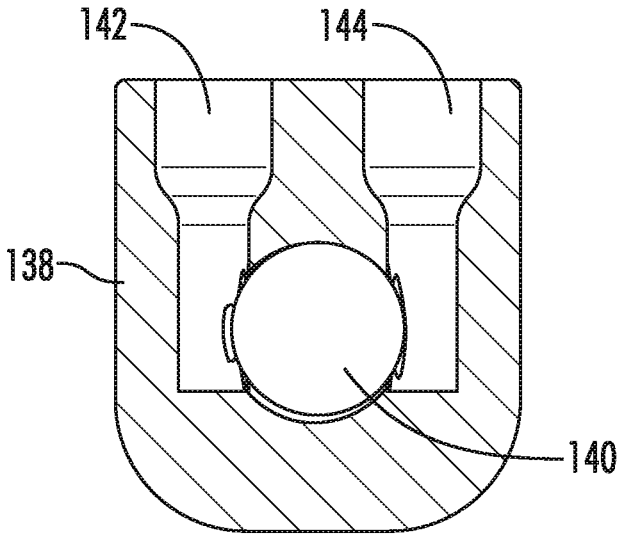
FIG. 17 is a sectional view thereof.

FIGS. 15-17 show another embodiment of suppressor device 138. The suppressor device 138 provides a bore 140 through which the projectile passes. The bore 140 provides a threaded connection on each side of the suppressor device similar to suppressor devices 100, 134. The threaded connection secures the suppressor device 138 to the barrel of the firearm. The other threaded connection secures a bushing, such as bushing 130, to the suppressor device 134, such as shown in FIG. 12. Vents 142, 144 extend from the bore 150 through the top of the suppressor device 134

Figure 18:
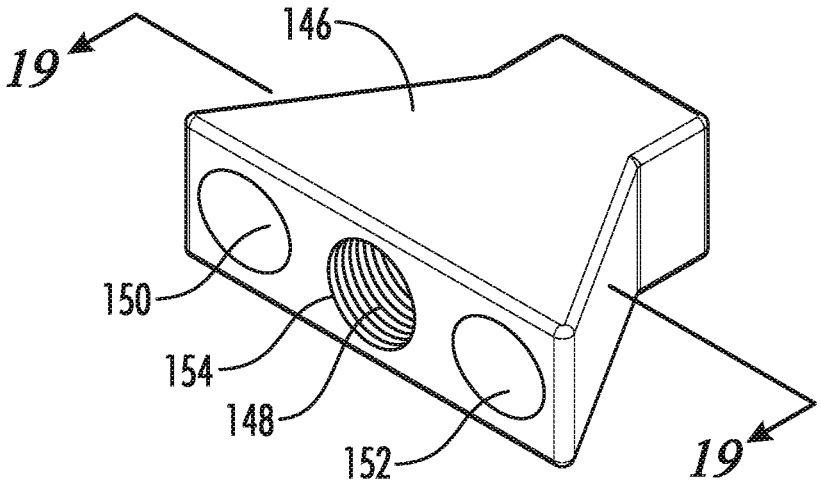
FIG. 18 is a perspective view showing one embodiment of the present invention.
Figure 19:
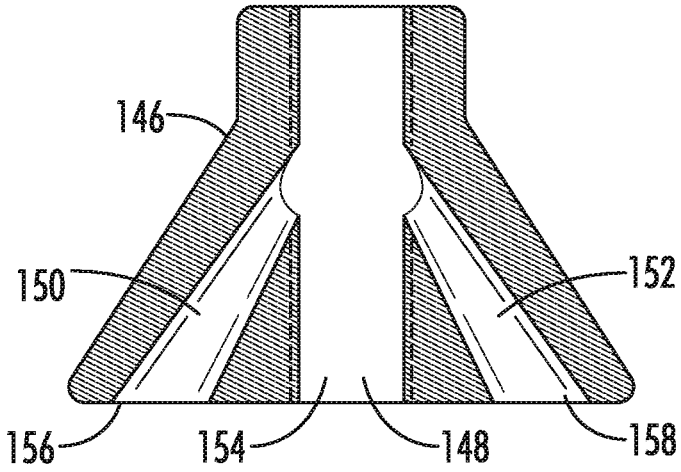
FIG. 19 is a sectional view thereof.

FIGS. 18 and 19 show another embodiment of the suppressor device 146. Bore 148 extends through the device 146. A threaded connection on the entrance and exit of bore 148 attaches the entrance 154 of the device 146 to the barrel and the exit attaches to bushing 130 as shown in FIG. 12. The vents 150, 152 are directed rearward to reduce recoil of the firearm. The openings of the vents enlarge as the gas is vented towards the exits 156, 158 of the vents 150, 152.

Figure 10:
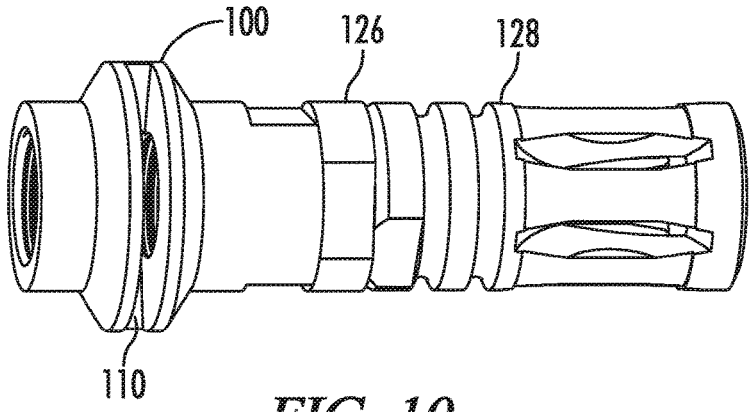
FIG. 10 is an environmental view thereof.

FIGS. 10-12 show the suppressor device 100 and the suppressor 148 as separate components. Separating the suppressor device 100 and the suppressor 148 allows the user to customize the placement and orientation of the suppressor device 100 and suppressor 148. In one embodiment, the suppressor device 100 and the suppressor 148 are affixed to each other such that a bushing is not required. Such an embodiment limits customization but simplifies attachment of the device.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A suppression device that attaches to a barrel of a firearm that aligns with the bore of the barrel to vent exhaust gas from firing a projectile from the firearm, the device comprising:

a suppression body having a bore extending along a longitudinal axis through the suppression body;

a vent extending radially from the bore through the suppression body;

an outer surface of the suppression body, wherein the outer surface of the suppression body defines the vent, wherein the vent forms an opening in the outer surface;

a first lip extending from the bore laterally outward to the outer surface of the suppression body, the first lip providing a rigid surface that forms a first interior edge of the vent, wherein the first lip forms a curve that extends laterally from the bore to the outer surface of the suppression body to form the first interior edge of the vent, wherein the first lip curves along a transverse plane perpendicular to the longitudinal axis, wherein a cross section of the bore in the transverse plane forms a circle;

a second lip extending from the bore laterally outward to the outer surface of the suppression body, the second lip providing a rigid surface that forms a second interior edge of the vent, wherein the second lip forms a curve that extends laterally from the bore to the outer surface of the suppression body to form the second interior edge of the vent, wherein the first lip and the second lip are located on opposite sides of the bore, wherein the second lip curves along the transverse plane.

2. The suppression device of claim 1 further comprising:

a suppression tail located at a first end of the suppression body, the suppression tail having a threaded connection within the bore wherein the suppression tail attaches to the barrel of the firearm.

3. The suppression device of claim 2 further comprising:

a suppression head located at a second end of the suppression body, the suppression head having a threaded connection within the bore.

4. The suppression device of claim 1 wherein the vent extends perpendicular from the bore through the suppression body.

5. The suppression device of claim 3 further comprising:

an adjustable bushing that secures to the suppression body at the threaded connection of the suppression head.

6. The suppression device of claim 5 further comprising:

a first nut that secures to the barrel and contacts the suppression tail to limit movement of the suppression body.

7. The suppression device of claim 6 further comprising:

a second nut that secures to the bushing and contacts the suppression head to limit movement of the suppression body.

8. The suppression device of claim 7 further comprising:

a second suppressor that secures to the bushing fore of the suppression head.

9. The suppression device of claim 8 further comprising:

a third nut that secures to the bushing and contacts the second suppressor to limit movement of the second suppressor.

10. The suppression device of claim 1 further comprising:

a first suppression shoulder located aft of the vent wherein the first suppression shoulder extends laterally outward from the bore;

a second suppression shoulder located fore of the vent wherein the second suppression shoulder extends laterally outward from the bore, wherein the vent provides an opening between the first suppression shoulder and the second suppression shoulder, wherein the first suppression shoulder and the second suppression shoulder are located adjacent the vent.

11. The suppression device of claim 10 further comprising:

the first lip providing the rigid surface that extends longitudinally from the first suppression shoulder to the second suppression shoulder;

the second lip providing the rigid surface that extends longitudinally from the first suppression shoulder to the second suppression shoulder;

wherein the first lip curves toward the opening along a lateral axis;

wherein the second lip curves toward the opening along the lateral axis, the first lip and second lip forming the same curve along the lateral axis.

12. A suppression device that attaches to a barrel of a firearm that aligns with the bore of the barrel to vent exhaust gas from firing a projectile from the firearm, the device comprising:

a suppression body having a bore extending along a longitudinal axis through the suppression body;

a vent extending radially from the bore through the suppression body;

an outer surface of the suppression body, wherein the outer surface of the suppression body defines the vent, wherein the vent forms an opening in the outer surface;

a first lip extending from the bore laterally outward to the outer surface of the suppression body, the first lip providing a rigid surface that forms a first interior edge of the vent, wherein the first lip forms a curve that extends laterally from the bore to the outer surface of the suppression body to form the first interior edge of the vent;

a second lip extending from the bore laterally outward to the outer surface of the suppression body, the second lip providing a rigid surface that forms a second interior edge of the vent, wherein the second lip forms a curve that extends laterally from the bore to the outer surface of the suppression body to form the second interior edge of the vent, wherein the first lip and the second lip are located on opposite sides of the bore;

an exhaust arc of the housing, wherein the exhaust arc curves adjacent the bore to define a portion of the bore at the vent, wherein a cross section of the exhaust arc at a transverse plane perpendicular to the longitudinal axis forms an arc adjacent the bore, wherein the first lip and the second lip form endpoints of the arc formed by the exhaust arc.

13. The device of claim 12 wherein the vent does not encompass the bore.

14. The device of claim 12 wherein the vent extends perpendicular from the longitudinal axis, the vent extending perpendicular from the bore through the suppression body.

15. The device of claim 12 further comprising:

a suppression tail located at a first end of the suppression body, the suppression tail having a threaded connection within the bore, wherein the suppression tail attaches to the barrel of the firearm;

a suppression head located at a second end of the suppression body, the suppression head having a threaded connection within the bore;

an adjustable bushing that attaches at the suppression head, the bushing defining a reversing chamber between the vent and the muzzle, wherein the bushing adjusts within the suppression head to vary a longitudinal distance between the vent and the muzzle of the firearm to vary the size of the reversing chamber.

16. The device of claim 12, wherein the first lip and the second lip curve at the first curve radius along a lateral axis.

* * * * *